US006035607A

United States Patent [19]

Miller

[11] Patent Number: 6,035,607

[45] **Date of Patent: *Mar. 14, 2000**

[54] APPARATUS AND SYSTEM FOR ON-THE-GO FILLING AND SEALING

[76] Inventor: Cardell Miller, 318 Westgrove Rd., Hudson, Wis. 54016

[ * ] Notice: This patent issued on a continued prosecution application filed under 37 CFR 1.53(d), and is subject to the twenty year patent term provisions of 35 U.S.C. 154(a)(2).

[21] Appl. No.: 09/008,085

[22] Filed: Jan. 16, 1998

[51] Int. Cl.[7] ..... B65B 3/00

[52] U.S. Cl. ..... 53/266.1; 53/329; 53/281; 53/272

[58] Field of Search ..... 53/467, 471, 473, 53/476, 478, 487, 266.1, 329, 272, 281, 329.2, 329.4; 156/69, 265

[56] References Cited

U.S. PATENT DOCUMENTS

| | | | |
|---|---|---|---|
| 3,965,656 | 6/1976 | Gerben | 53/329.4 |
| 4,095,390 | 6/1978 | Knudsen | 53/329.4 |
| 4,180,961 | 1/1980 | Collins, III | 53/478 |
| 4,388,795 | 6/1983 | Stohlquist et al. | 53/435 |
| 4,539,456 | 9/1985 | Mohr | 219/10.69 |
| 4,719,739 | 1/1988 | Foldesi | 53/306 |
| 4,729,206 | 3/1988 | Francis et al. | 53/297 |
| 4,816,110 | 3/1989 | Foldesi et al. | 156/499 |
| 5,373,683 | 12/1994 | Kronseder | 53/281 |
| 5,522,200 | 6/1996 | Foldesi et al. | 53/75 |

*Primary Examiner*—Eugene L. Kim
*Attorney, Agent, or Firm*—Jacobson & Johnson

[57] ABSTRACT

A system and method for on-the-go forming of a cover seal, on-the-go filling of a container and on-the-go induction sealing of a cover seal to a container with the system including a first transfer mechanism for picking empty containers from a conveyor, a traveling punch for on-the-go punching a cover seal from a roll of cover seal material, a rotateable head carrying a set of positionable filler spouts that fill the containers to a preselected level and a set of elevator platforms that raise and lower a container located thereon to facilitate low splash filling, a cam-and-spring system for maintaining a cover seal in pressure contact with a container, a cover-sealing apparatus for on-the-go inductive sealing of a cover seal to a container and a second transfer mechanism for returning the filled and sealed containers to the conveyor.

9 Claims, 5 Drawing Sheets

APPARATUS AND SYSTEM FOR ON-THE-GO FILLING AND SEALING

FIELD OF THE INVENTION

This invention relates generally to filling and sealing system and, more specifically, to a system for on-the-go filling of a container, on-the-go forming a cover seal and on-the-go induction sealing of a cover seal to a container.

BACKGROUND OF THE INVENTION

The concept of continuous motion in-line sealers for sealing foils to containers is known in the art. For example, U.S. Pat. No. 4,816,110 shows a sealing system that includes a rotateable turret that has a pocket wheel to hold containers. Associated with the rotateable turret is a foil transfer and sealing mechanism that uses an induction heater to seal the foil cover to the container. In contrast, the present system includes a postionable filling device to fill the container, a flying punch to form a cover seal and an induction sealing mechanism to seal the cover seal to the container in one continuous operation.

The concept of induction heating is well known in the sealing art and is used to seal metal foil covers to containers. Typically, in induction heating an electrical conducting material, such as a the foil cover with a hot-melt adhesive, is placed in a varying magnetic field which heats the electrical conducting material to melt the adhesive. In the container art, induction heating is a preferred method as one can quickly secure an electrical conducting foil cover to a container by inductively heating the foil cover to melt or soften an adhesive located on the cover. When the adhesive is heated to a condition for adhesively bonding the cover seal to the container, the cover seal and container are maintained in contact with one another to allow the adhesive to set and adhesively secure the cover seal to the container.

One of the difficulties with induction heating and filling is that the filling and the sealing are done in separate regions which require transferring a filled container across some interface before the cover seal can be sealed to the container. The transfer inevitably involves jostling the container which can cause spilling of the contents of the container. To minimize spillage problems the containers are usually only partially prefilled. The present invention provides a method and apparatus for filling a container and sealing a cover seal to a container that allows the containers to be filled and handled without the jostling that might spill the contents of the container. In addition, there is no relative motion between the cover-seal holding mechanism and the elevator platforms supporting the containers during both the heating and the cooling.

The present invention provides an apparatus for on-the-go filling a container, on-the-go forming of a cover seat and on-the-go sealing of a cover seal to the container in a continuous operation through a rotating head that carries a traveling punch and a set of postionable filling spouts. The system includes cam-controlled elevator platforms that maintain the containers in a position for low splash filling and, after the filling process is complete, the elevator platforms maintain the cover seals in pressure engagement with the containers, so that the cover seals can be inductively sealed to the containers by an induction-sealing apparatus located above the rotating head.

DESCRIPTION OF THE PRIOR ART

U.S. Pat. No. 4,539,456 discloses an induction heating system for sealing a top member to a bottom member as the members are moved along a conveyor belt.

U.S. Pat. No. 4,719,739 discloses a continuous motion in-line sealer that use the reciprocal motion of a vacuum head to apply a seal to a container.

U.S. Pat. No. 4,682,463 discloses a device for forming an attaching flexible foil sealing disk to a container.

U.S. Pat. No. 5,522,200 shows a continuous motion sealer that cuts a seal from a roll of material and then heat-seals the seal to a container.

SUMMARY OF THE INVENTION

Briefly, the invention comprises a system and method for on-the-go forming of a cover seal, on-the-go filling of a container and on-the-go induction sealing of a cover seal to a container with the system including a first transfer mechanism for picking empty containers from a conveyor, a traveling punch for on-the-go punching a cover seal from a roll of cover seal material, a rotateable head carrying a set of postionable filler spouts that fill the containers to a preselected level and a set of elevator platforms that raise and lower a container located thereon to facilitate low splash filling, a cam and spring system for maintaining a cover seal in pressure contact with a container, a cover-sealing apparatus for on-the-go inductive sealing of a cover seal to a container and a second transfer mechanism for returning the filled and sealed containers to the conveyor.

DESCRIPTION OF THE PREFERRED EMBODIMENT

The present system and method for on-the-go filling and on-the-go sealing of a container includes a first transfer mechanism for removing individual empty containers from a conveyor, a traveling punch for on-the-go punching of a cover seal from a roll of cover seal material having an adhesive thereon, a rotating head having a set of radially postionable filler spouts that fill the containers to a preselected level, a rotating support for a set of elevator platforms that raise and lower a container located thereon to facilitate the filling and sealing, an induction cover sealing apparatus for inductively sealing a cover seal to a container as the cover seal and container pass thereunder while the elevator platforms hold the cover seals in pressure contact with the containers as the adhesive sets and a second transfer mechanism for returning the filled and sealed container to the conveyor.

Figure 1:
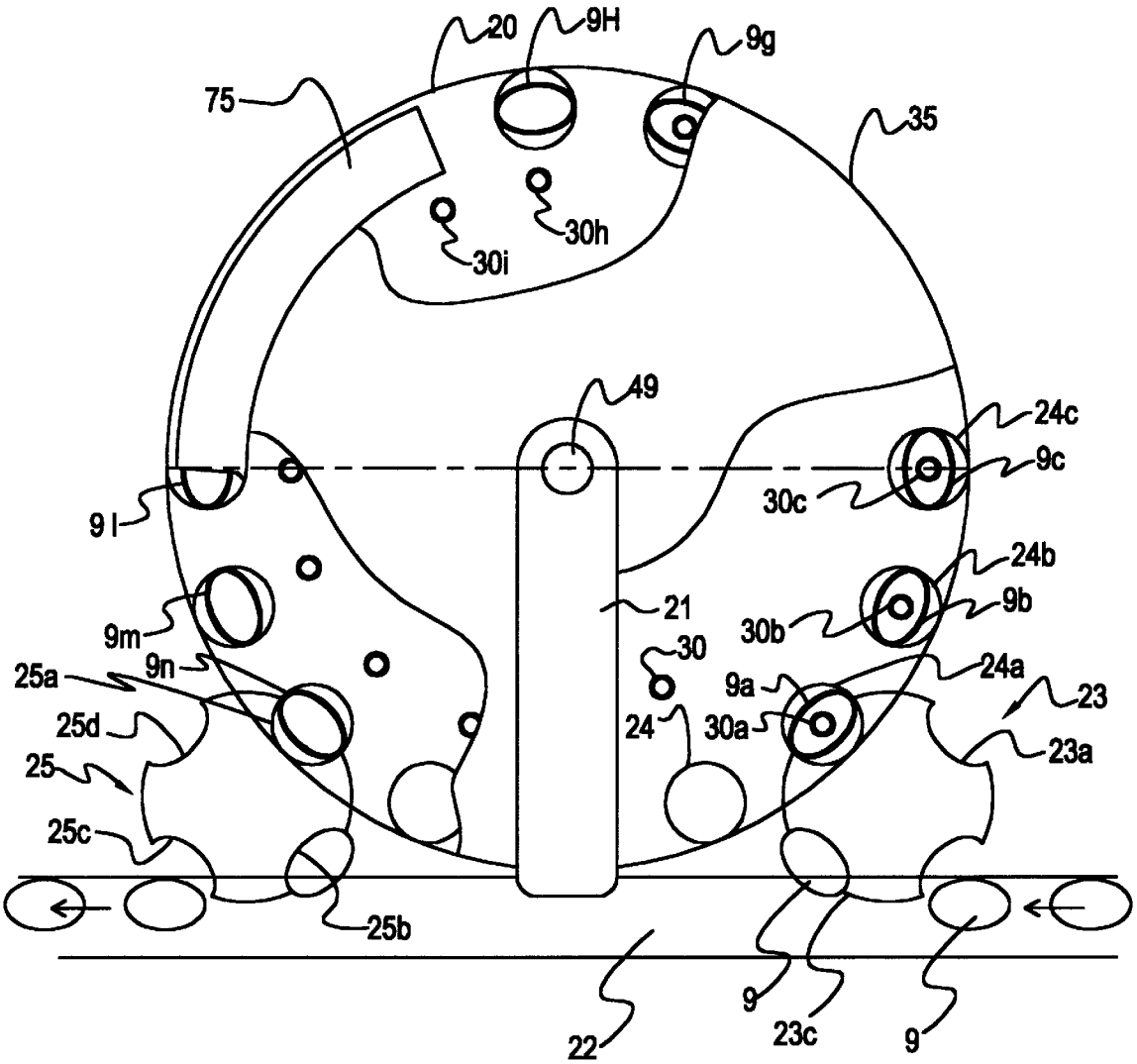
FIG. 1 is a partial top view showing the rotating head for on-the-go filling and sealing of containers located beneath a plate that is partially cutaway.

To illustrate the various features of the invention, refer to FIG. 1. FIG. 1 is a partial top view showing a drive shaft 49 that drives a circular rotating head 20 for on-the-go filling and sealing a plurality of containers. Rotating head 20 is partially covered by a top plate 35 that is shown partially in cross section to reveal various components of the system as well as the rotating head. Plate 35 and rotating head 20 are made from a non-electrical conducting material such as polycarbonate or fiberglass. Rotating head 20 is powered by a source (not shown) and rotates in the counterclockwise direction through drive shaft 49.

Extending tangentially to rotating head 20 is a conveyor 22 that brings empty containers 9 to a first container transfer mechanism 23 and receives filled and sealed containers from a second container transfer mechanism 25. That is, container transfer mechanism 23 transfers empty containers 9 onto the rotating head 20 while the second transfer container mechanism 25 returns the sealed and filled containers to the conveyer 22. Rotating head 20 rotates in a counterclockwise direction while conveyor 22 moves right to left to continually convey empty containers to transfer mechanism 23 while the second container transfer mechanism 25 continually returns filled and sealed containers to conveyor 22.

Extending radially outward from top plate 35 in the six-o'clock position is a traveling punch mechanism 21 for cutting a cover seal from a roll of cover-seal material and placing the cover seal in a cover-seal holding apparatus that can carry the cover seal to a position where the cover seal can be induction sealed to the top of a filled container. FIG. 1 shows traveling punch mechanism 21 in the initial or prepunch position; however, during the cover seal punching operation, the traveling punch locks to the rotating head and travels in a counterclockwise direction with the rotating head 20 for about 15 degrees at which time the traveling punch is released from the rotating head and allowed to return to the start position shown in FIG. 1.

Plate 35 is shown in cutaway with a first cutaway from the six-o'clock to the three-o'clock position, a second cutaway at the 12 o'clock position and a third cutaway at the nine-o'clock to the six-o'clock position. The cutaway views reveal the rotating head 20 and the containers carried by the rotating head 20. The first cutaway position between six-o'clock and three-o'clock shows a first container-transfer mechanism 23 comprising a wheel with notches 23*a*, 23*b*, and 23*c* therein for engaging and transferring empty containers 9 from conveying line 22. The transfer mechanism wheel rotates in a clockwise direction to pick and place an individual empty container on an individual elevator platform. Reference numeral 24 identifies one of the individual elevator platforms and reference numeral 9 identifies one of the empty containers. A set of identical elevator platforms are circumferentially spaced around the perimeter of rotating head 20 with the spacing equidistant between each of the elevator platforms That is, circumferentially spaced platforms 24*a*, 24*b*, and 24*c* are shown with containers 9*a*, 9*b* and 9*c* thereon. The elevator platforms are mounted on a lower rotating support (not shown) that is connected to drive shaft 49 to maintain the elevator platforms in synchronous rotation with rotating head 20.

Located in the first cutaway is a schematic representation of a set of 16 radially postionable spouts for filling the containers. The end of positionable spouts are shown in outline form and are identified in the first cutaway by reference numeral 30, 30*a*, 30*b* and 30*c*. Filler spout 30 is located in the radially retracted position while filler spouts 30*a*, 30*b* and 30*c* are located in the extended position for filling a container thereunder. In the retracted position spout 30 is located radially inward from platform 24 and from containers 9. When the spouts are moved outward as illustrated by spouts 30*a*, 30*b* and 30*c*, the end of the spouts are in central alignment with the containers with the spouts extending downward into the containers to provide low splash filling of the containers.

Referring to the 12 o'clock position, the second cutaway reveals containers 9*g* with spout 30*g* central located therein. Adjacent to container 9*g* is container 9*h* with radially positionable filler spout 30*h* shown in the retracted and non-filling position. At this point the filling of the containers has been completed. Extending partially over the second cut-away area is an elongated, arcuate-shaped induction sealing mechanism 75 that is mounted to the underside of stand 80 and extends from the nine-o'clock to the 12 o'clock position. It is in this region of the plate 35 that the cover seals are inductively sealed to the container as the rotating head 20 carries the containers in a counter-clockwise direction beneath induction sealing mechanism 75. It should be pointed out that for clarity, the set of 16 cover-holding mechanisms are not shown in FIG. 1 but are carried on the underside of rotating head 20 and maintain the cover seal in a ready-to-seal position after the cover seal has been punched by flying punch 21. A cross-sectional view of a cover-holding mechanism 48 is shown in detail in FIG. 4.

Referring to the nine-o'clock to the six-o'clock position, which is the third cutaway, the sealed containers 9*l*, 9*m* and 9*n* are shown moving counterclockwise toward the second container-transfer mechanism 25 which includes a pick-off wheel having notches 25*a*, 25*b*, 25*c* and 25*d* for engaging and transferring filled and sealed containers to conveyor line 22. It is in this region the sealing takes place without any relative motion between the cover and the container.

Thus, the mechanism as outlined above provides for removal of an empty container from a conveyor line, filling the container, inductive sealing of a cover seal to the container and returning the filled and sealed container to the conveyor line.

To appreciate the various components of the system that enable the on-the-go filling and on-the-go sealing of the containers, refer to the remaining figures which show in isolation the various components of the system. It should be also pointed out that while the present invention is shown to have a rotating head to accommodate 16 containers, the system could be made larger or smaller to accommodate more or fewer containers during the on-the-go filling and on-the-go sealing of the containers.

Figure 2:
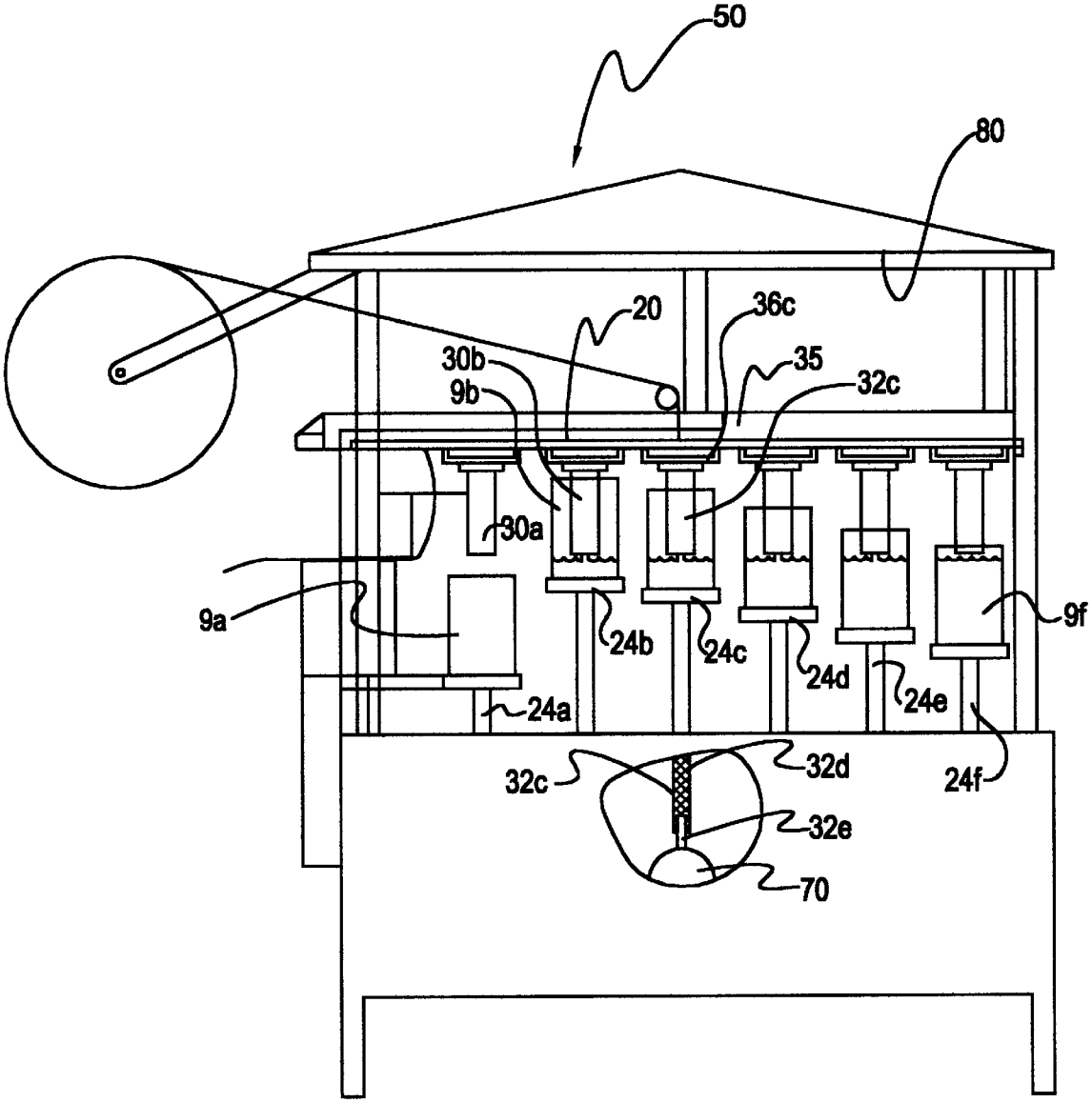
FIG. 2 is a right side view of my system illustrating the on-the-go filling of the containers.

FIG. 2 is a right-side elevation view showing rotating head 35 and a portion of the 16 elevator platforms with containers being filled thereon. Elevator platforms 24*a*, 24*b*, 24*c*, 24*d*, 24*e*, and 24*f* are shown in various vertical positions. Elevator platforms and rotating head 20 are rotating in unison. To appreciate the on-the-go filling, selected elevator platforms will be described to reveal the on-the-go low splash filling of the containers.

Located on elevator platform 24*a* is container 9*a* with filler spout 30*a* positioned above container 9*a*. In this position the end of filler spout 30*a* is not delivering fluid to container 9*a* but is located in substantial coaxial alignment therewith as shown in FIG. 1.

Located next to platform 24*a* is platform 24*b* with container 9*b* thereon and with end-of-filler spout 30*b* extending downward into container 9*b*. In this condition fluid 40 is being delivered to container 9*b* in a low splash condition. That is, the end of filler spout 30*b* is located close to the fluid level 40 within container 9*b* so that splashing of the fluid is minimized as the fluid flows into the container.

Located next to platform 24*b* is platform 24*c* with container 9*c* thereon having more fluid 40 than container 9*b* but with the end of filler spout 30*c* spaced from the top of the fluid about the same distance that filler spout 30*b* is spaced from fluid 40 in container 9*b*. That is, during the filling process the elevator platforms are lowered to maintain a substantially small but constant distance between the level of the fluid and the end of the spouts, so that the containers can be filled with a minimum of splashing. To illustrate the raising and lower of elevator platform 31*c*, the housing of system 50 has been cutaway to reveal a cam member 70 for raising and lowering elevator platform 31*c*. In addition, a compression spring 32*d* engages push rod 32*e* which slides within shaft 32*c* to provide a spring resistance to enable the containers to be brought into pressure contact with the induction-sealing mechanism.

To illustrate the filled condition, refer to elevator platform 34*f* which supports container 9*f* with the container being filled to the top of the container. In the next step platform 24*f* is lowered until the end of filler spout 30*f* clears the top of container 9*f* and the filler spout 30*f* is retracted radially inward to a non-filling position. The non-filling position is illustrated in FIG. 1 by the position of the end of spout 30*h* located radially inward of container 9*h*.

Thus, FIG. 2 illustrates the various stages in the on-the-go filling of the individual containers by raising and lowering of individual elevator platforms that carry individual containers thereon as the elevator platforms rotate in synchronous motion with rotating head 20.

Figure 3:
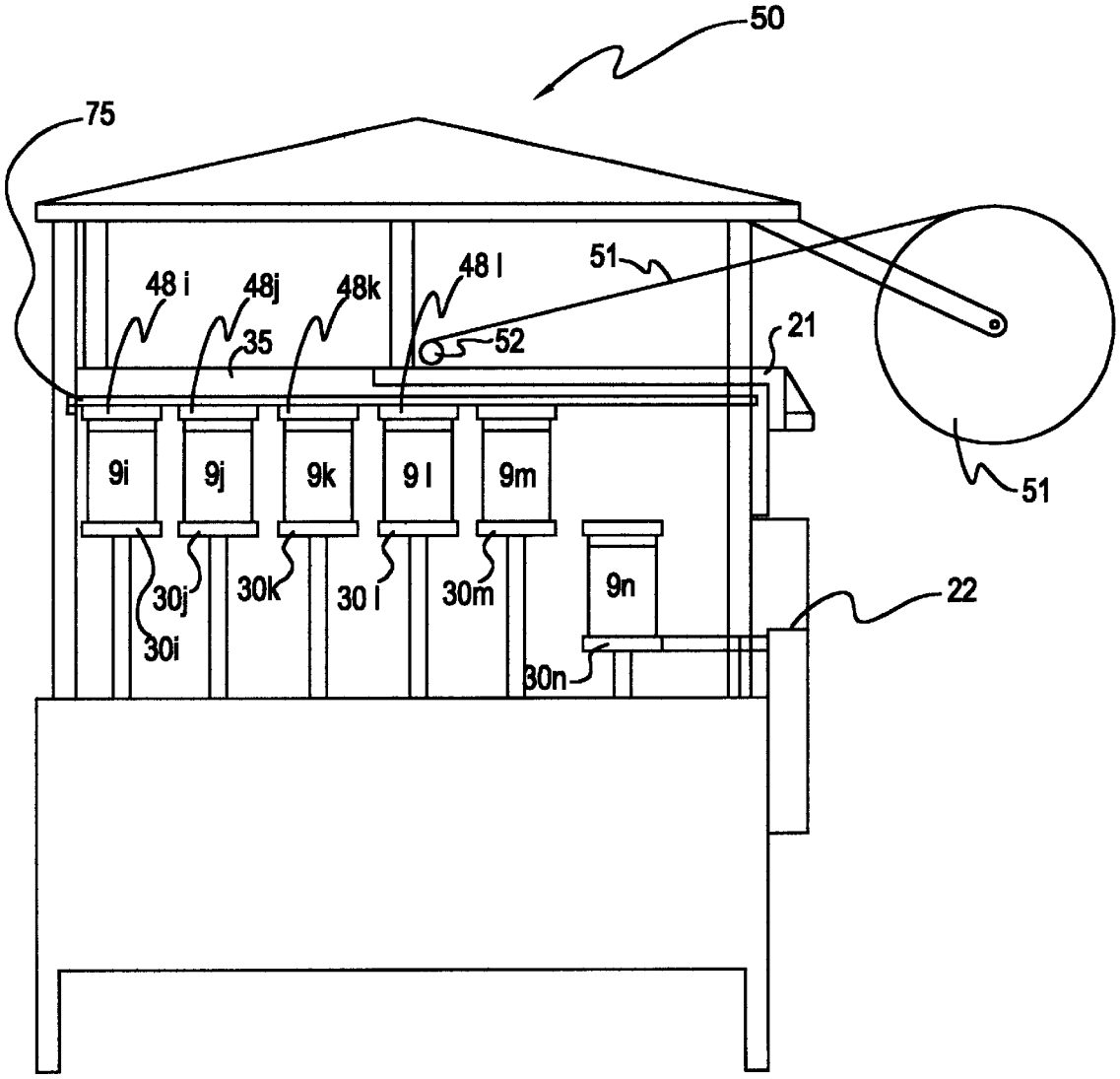
FIG. 3 is a left side view of my system illustrating the on-the-go induction sealing of the containers.

FIG. 3 show a right side view of plate 35 with the arcuate-shaped induction-sealing apparatus 75 located thereon. Located below rotating head 20 are containers 9*i*, 9*j*, 9*k*, and 9*l* which are in the process of having a cover seal inductively sealed to the respective containers. Container 9*n* is shown in the second transfer position where the filled and sealed containers can be removed and returned to conveyor 22. Thus, FIG. 3 illustrates the position of the filled containers as the cover seals are inductively sealed as the cover seals and containers move beneath the induction-sealing mechanism 75. As the containers and cover seals move beneath the induction-sealing apparatus the springs located in the elevator platforms (FIG. 2) maintain the containers in pressure contact with the cover seals located in the cover-seal holding mechanisms located on the underside of rotating head 20. Reference numeral 48*i*, 48*j*, 48*k* and 48*l* identify the cover-seal holding mechanisms that are holding the cover seals in a sealing condition. While only cover-seal holding mechanisms 48*i*, 48*j*, 48*k* and 48*l* are identified the cover-seal holding mechanisms are located in an equally spaced circumferentially position on the underside of rotating head 20 with an individual holding mechanism positioned beneath an individual elevator platform so that a container on the elevator platform can be brought into engagement with a cover seal in the cover-seal holding mechanism during the induction-sealing process.

Station 50 is shown with uncut foil 51 that passes over a roller 52 and into the punch mechanism 21 identified in FIG. 1. Foil 51 includes a layer of hot-melt adhesive on one side for securing the foil to a container. To appreciate the flying-punch mechanism and the cover-seal holding mechanism, refer to FIG. 4 which shows punch mechanism 21 in a partial cutaway view together with a partial cutaway view of the cover-seal holding mechanism.

A central shaft 49 is shown supporting rotatable head 20 with the punch mechanism frame extending outward around the end of rotatable head 20. A shot pin cylinder 54 is located on the end of the punch mechanism and includes a retractable shot pin 55 that can be extended into temporary engagement with rotatable head 20 so that rotatable head 20 and the punch mechanism rotate as a unit during the punching of the cover seal from cover seal material 51. Attached to the punch mechanism frame 21 and located under rotatable head 20 is punch 61 and die 62 for punching a cover seal from foil material 51.

Attached to the underside of rotating head 20 is one of the cover-seal holding mechanisms 48 which is shown in section and includes a circular focusing puck 56 and a focusing ring 57 together with a resilient pad 58. Cover-seal holding mechanism 48 receives and holds a cover seal therein as the cover seal and container are directed under an elongated induction coil located in the induction-sealing apparatus 75 (FIG. 1). A cover-seal holding mechanism and induction-sealing apparatus suitable for use in the present invention are shown and described in our co-pending application title INDUCTION SEALING OF COVERS WITH TABS filed on even date herewith.

Figure 4:
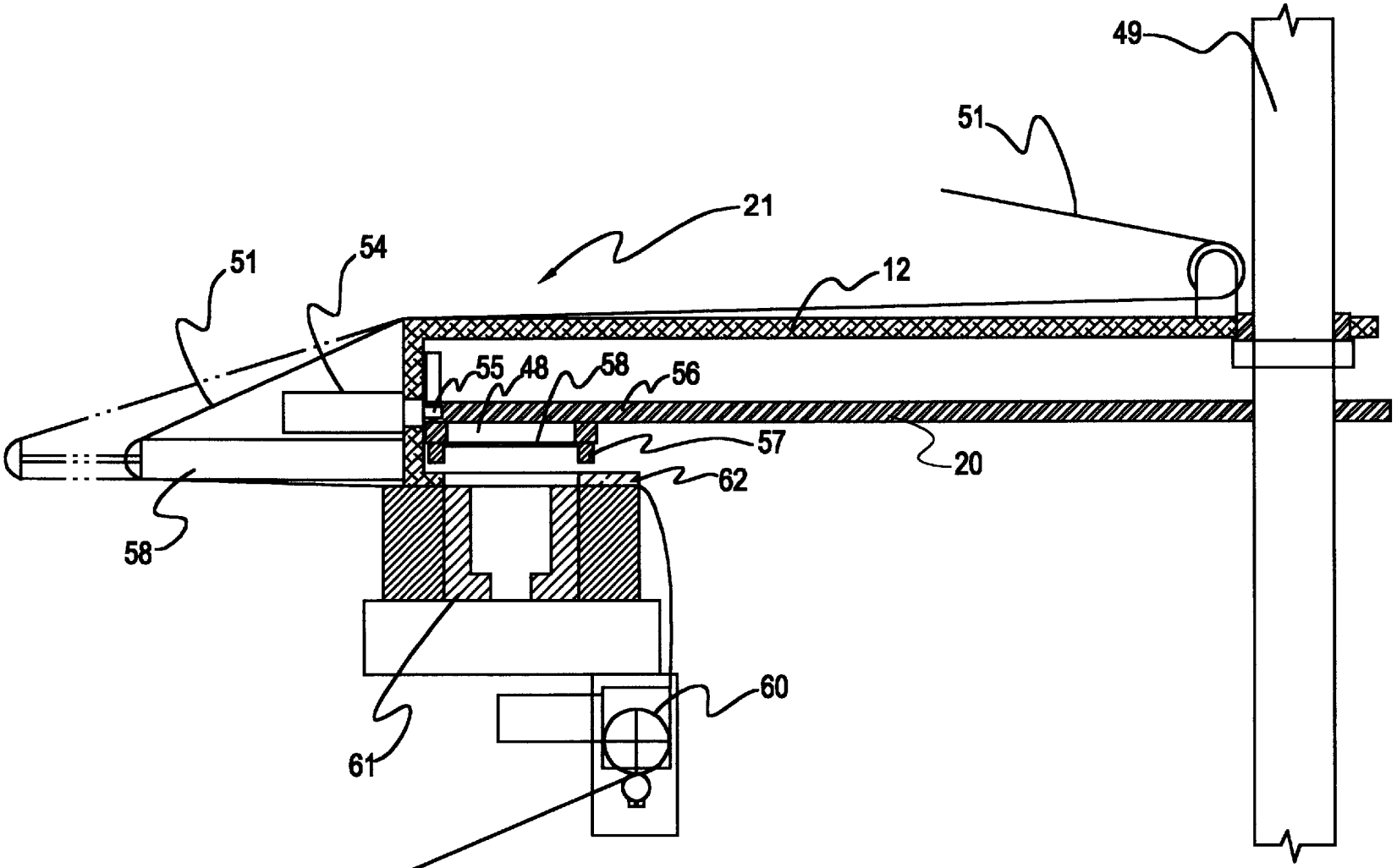
FIG. 4 is a partial cutaway side view showing the flying punch for forming of a cover seal from a roll of cover-seal material.

To appreciate the flying punch of the invention and the punching of the foil to form a cover seal, refer to FIG. 4 which shows foil 51 extending along punch mechanism 21 and over a slack cylinder 58 that extends outward to maintain the foil material in a taut condition. Located under rotating head 20 is the foil-drive mechanism 60 for pulling foil 51 through the die 62 and punch 61. Foil 51 is shown extending through die 62 which is located adjacent to foil-drive mechanism 60. Punch 61, which is activateable by a pressure cylinder, can be driven upward through die 62. As punch 61 passes through die 62, a portion of foil 51 located in die 62 is cut out of foil material 51 and driven upward into the cover seal-holding member 48. The cover seal-holding member includes a resilient pad 58 to provide surface support for a cover seal therein. The cover seal can be held by friction within holding member 48 or, if desired by a vacuum source located in holding member 48.

Once the punch 61 passes through die 62 and delivers the cover seal into the cover-seal holding mechanism 48, the punch 61 is retracted as is shot pin 55. The retraction of shot pin 55 allows the punch mechanism 21 to return to the original six-o'clock position as shown in FIG. 1 at which time toe web is advanced to punch out the next foil cover. Thus, the punch mechanism provides for on-the-go punching of the foil as the punch mechanism is temporarily locked to rotating head 20 during the punching process to permit one to place the cover seal in the cover-seal holding mechanism during the continued rotation of rotatable head 20. That is, once the cover seal is in place in the cover-seal holding mechanism 48, shot pin 55 is unlocked from the rotating head 20 to ready the punch mechanism for the process of punching another cover. Thus, with the components shown in FIG. 4, one can punch and place a cover seal from a roll of cover seal material during the continuous rotation of the rotating head.

Figure 5:
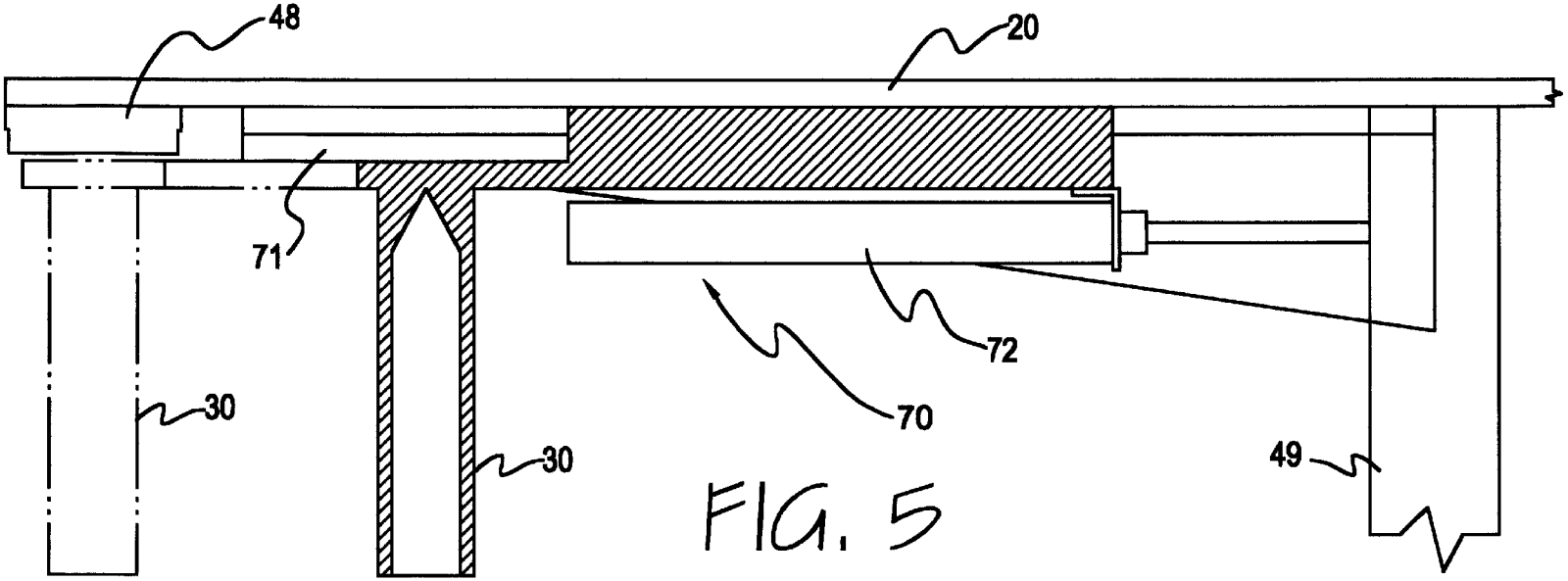
FIG. 5 is a partial side view of the positionable filler spout with the filler spout illustrated in the filling position and the non-filling position.
Figure 6:
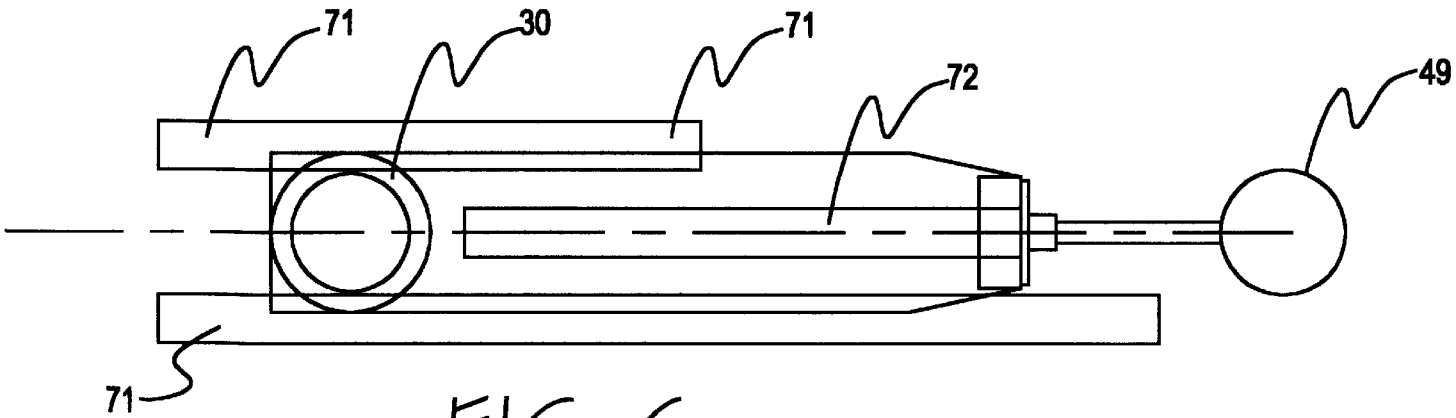
FIG. 6 is a bottom view of the positionable filler spout of FIG. 5.

To appreciate the postionable spout-filling mechanism of the present invention, refer to FIG. 5 which shows the postionable spout-filling mechanism side view and to FIG. 6 which shows postionable spout-filling mechanism in bottom view. Spout-filling mechanism 70 includes spout 30 which slidingly attaches to a bracket 71 mounted on the underside of rotating head 20. An air cylinder 72 connects to shaft 49 and to spout 30 so that one can slide spout 30 inward or outward. Spout 30 is shown in the retracted position (solid lines) with 30' (dashed lines) identifying the position of spout 30 in the extended or filing position. Thus, in the operation of the spout-filling mechanism 70 the spout 30 is extended radially outward to the filling position as indicated by 30' or retracted to the non-filling condition as indicated by the solid lines. A source of fluid (not shown) connects to spout 30 so that fluid can be delivered out of the lower end of spout 30.

The system 50 thus provides an apparatus and method for on-the-go punching of a foil cover, on-the-go filling and on-the-go induction sealing of a cover seal to a container comprising the steps of:

(a) an on-the-go punching and placing of a cover seal from a web of foil material 51

(b) moving an empty container from a conveyor line;

(c) moving postionable spouts into position for low splash filling of the containers;

(d) on-the-go filling the containers as the containers are being lowered by elevator platforms;

(e) moving the positionable spouts to a non-filling condition;

(f) elevating a container top to a position proximate a cover seal so that the cover seal extends over the container top with a hot-melt adhesive located above the container top;

(g) moving the container with the cover seals located thereabove into a position where the container can be brought into pressure contact with the cover seal;

(h) moving the cover seal and container beneath an induction-sealing apparatus (i) on-the-go induction sealing of the cover seal to the container by application of an electrical current to an induction-heating coil to heat the hot-melt adhesive to sufficiently high temperature to melt the hot-melt adhesive thereon;

(j) allowing the cover seal and container to cool below the solidification temperature of the hot-melt adhesive while maintaining pressure between the cover seal and the container to enable the hot-melt adhesive to solidify and thereby adhesively seal the cover seal to the container mouth while continuing to move the cover seal and the container;

(k) returning the filled and sealed container to the conveyor.

We claim:

1. A system for on-the-go filling and on-the-go sealing of containers comprising:

a conveyor;

a first transfer mechanism for transferring an empty container from the conveyor;

a rotating head carrying a container-filling apparatus;

a platform for supporting a container with the platform rotating in unison with the rotating head;

a flying punch for forming a cover seal from a roll of cover-seal material, said flying punch including a member for temporarily engaging said flying punch to said rotating head;

a positionable spout for low splash filling of the empty container to produce a filled container;

an induction-sealing apparatus for sealing the cover seal to the filled container to produce a filled and sealed container before the container is transferred from the platform; and a second transfer mechanism for returning the filled and sealed container to the conveyor.

2. The apparatus of claim 1 including a set of elevator platforms that raise and lower the container located thereon to facilitate low splash filling of the empty container.

3. The apparatus of claim 2 including a compression spring for maintaining the cover seal in pressure contact with the filled container during the inductive sealing of the cover seal to the filled container.

4. The apparatus of claim 2 including a cam member for elevating and lowering said elevator platforms.

5. The apparatus of claim 2 including a shot pin cylinder for temporarily engaging said flying punch to said rotating head.

6. The apparatus of claim 2 wherein said set of elevator platforms are located below said rotating head.

7. The apparatus of claim 2 wherein said flying punch includes a punch and die.

8. The apparatus of claim 2 wherein said flying punch includes a slack cylinder to maintain the foil material in a taut condition for punching.

9. The apparatus of claim 2 including a cylinder for extending or retracting said positionable spout.

* * * * *